US011380228B2

(12) United States Patent
Martinsen et al.

(10) Patent No.: US 11,380,228 B2
(45) Date of Patent: Jul. 5, 2022

(54) SMARTFLAG

(71) Applicants: Per Oivind Martinsen, Oslo (NO); Preben N. Martinsen, Oslo (NO)

(72) Inventors: Per Oivind Martinsen, Oslo (NO); Preben N. Martinsen, Oslo (NO)

( * ) Notice: Subject to any disclaimer, the term of this patent is extended or adjusted under 35 U.S.C. 154(b) by 904 days.

(21) Appl. No.: 16/083,925

(22) PCT Filed: Mar. 15, 2017

(86) PCT No.: PCT/NO2017/050067
§ 371 (c)(1),
(2) Date: Sep. 11, 2018

(87) PCT Pub. No.: WO2017/160161
PCT Pub. Date: Sep. 21, 2017

(65) Prior Publication Data

US 2019/0096295 A1 Mar. 28, 2019

(30) Foreign Application Priority Data

Mar. 16, 2016 (NO) ..... 20160463

(51) Int. Cl.
*G09F 17/00* (2006.01)
*E04H 12/32* (2006.01)

(52) U.S. Cl.
CPC ..... *G09F 17/00* (2013.01); *E04H 12/32* (2013.01); *G09F 2017/0025* (2013.01)

(58) Field of Classification Search
CPC .. G09F 17/00; G09F 2017/0025; E04H 12/32
See application file for complete search history.

(56) References Cited

U.S. PATENT DOCUMENTS 960,669 A * 6/1910 Morgan ..... G09F 17/00 116/173
1,321,837 A * 11/1919 Mader ..... G09F 17/00 116/173
1,508,980 A 9/1924 Kelly
1,610,663 A * 12/1926 Diago ..... E04H 12/32 116/173
2,452,842 A * 11/1948 Davis ..... B60R 13/00 116/173
2,870,559 A * 1/1959 Shaughnessy ..... E04H 12/32 40/614
3,273,273 A * 9/1966 McLarty ..... G09F 17/00 116/173

(Continued)

FOREIGN PATENT DOCUMENTS

CN 2361756 Y 2/2000
CN 2537783 Y 2/2003

(Continued)

*Primary Examiner* — Nimeshkumar D Patel
*Assistant Examiner* — Tania Courson
(74) *Attorney, Agent, or Firm* — GableGotwals

(57) ABSTRACT

A system and method for automatically raising and lowering of at least one flag or pennant comprising at least one flag or pennant, a flagpole, a line and a container. The container has at least two chambers, each chamber has at least one drum. The drum is controlled by at least one motor, a line extending from a first drum via a guide in the top of the flagpole to a second drum.

9 Claims, 1 Drawing Sheet

(56) References Cited

U.S. PATENT DOCUMENTS

| | | | | | |
|---|---|---|---|---|---|
| 3,417,732 | A * | 12/1968 | Platt, Jr. | G09F 17/00 | 116/173 |
| 3,418,967 | A * | 12/1968 | Donkersloot | G09F 17/00 | 116/173 |
| 3,476,929 | A * | 11/1969 | Klinger | F21V 33/00 | 362/307 |
| 3,923,001 | A * | 12/1975 | Murdock | G09F 17/00 | 116/173 |
| 3,952,695 | A * | 4/1976 | Vollstedt | E04H 12/003 | 116/173 |
| 5,373,287 | A * | 12/1994 | Doublet | G09F 17/00 | 116/173 |
| 5,572,835 | A * | 11/1996 | Atkins | G09F 17/00 | 116/173 |
| 6,883,459 | B2 * | 4/2005 | Maki | G09F 17/00 | 116/173 |
| 7,426,899 | B1 * | 9/2008 | Heva | G09F 17/00 | 116/173 |
| 8,813,674 | B2 * | 8/2014 | Tait | G09F 17/00 | 116/173 |
| 9,070,309 | B2 * | 6/2015 | Proctor | G09F 17/00 | |
| 9,093,001 | B1 * | 7/2015 | Heva | E04H 12/32 | |
| 10,115,325 | B2 * | 10/2018 | Scaturro | G09F 11/21 | |
| 10,801,229 | B1 * | 10/2020 | George, Sr. | E04H 12/32 | |
| 2001/0010201 | A1 * | 8/2001 | Otterness | G09F 17/00 | 116/173 |
| 2008/0121167 | A1 * | 5/2008 | Randall | G09F 17/00 | 116/173 |
| 2010/0101479 | A1 * | 4/2010 | Grahl | E04H 12/32 | 116/173 |

FOREIGN PATENT DOCUMENTS

| | | | | | |
|---|---|---|---|---|---|
| FR | 2937779 | B1 | 4/2010 | | |
| JP | 2011028193 | A * | 2/2011 | | |
| WO | WO-9709500 | A1 * | 3/1997 | E04H 12/32 | |
| WO | 2010016788 | A1 | 2/2010 | | |
| WO | WO-2017160161 | A1 * | 9/2017 | G09F 17/00 | |

* cited by examiner

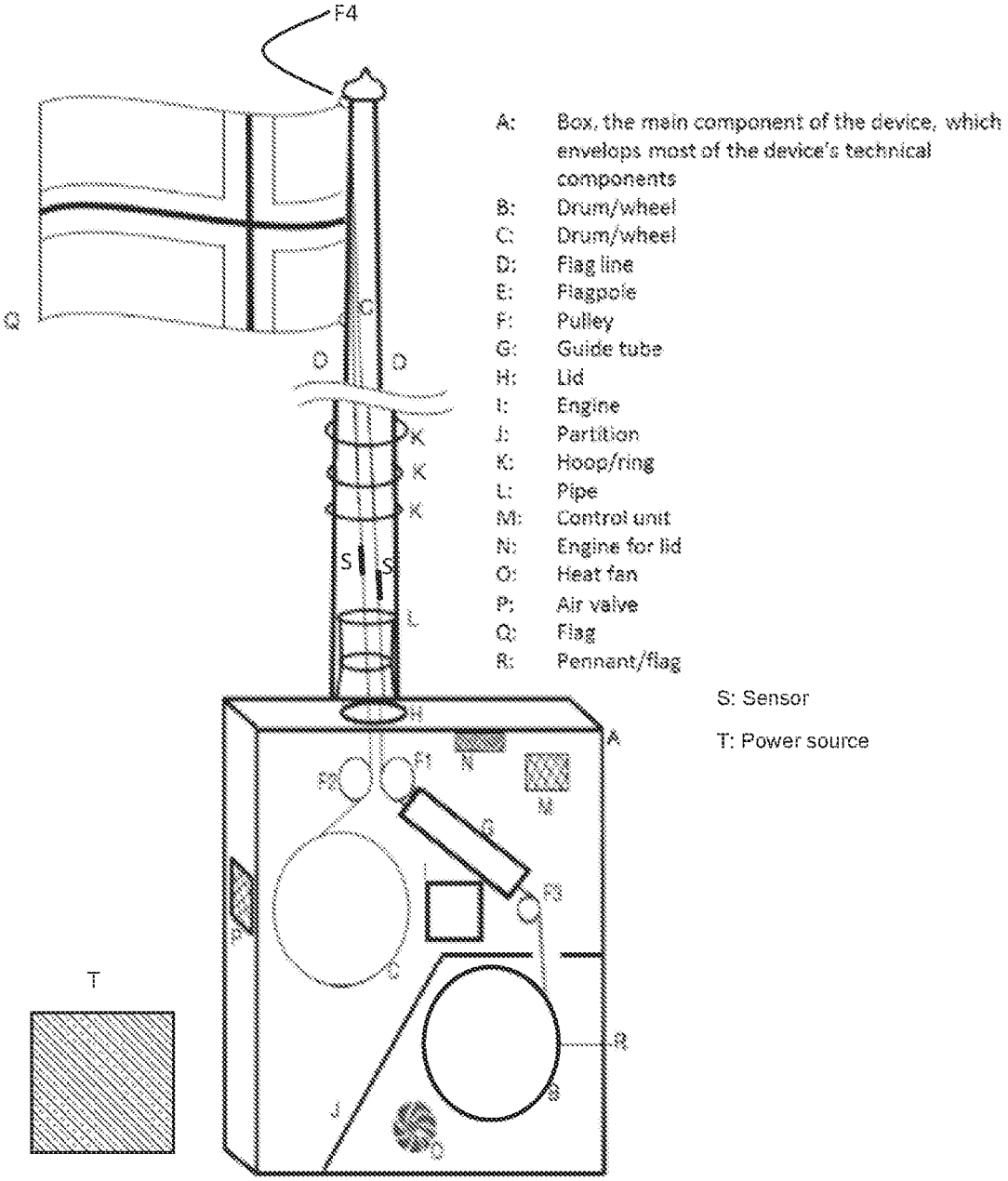
F4
Q
C
D
D
K
K
K
S
S
L
H
A
N
F2
F1
M
G
I
F3
P
E
T
R
B
J
O
A: Box, the main component of the device, which envelops most of the device's technical components
B: Drum/wheel
C: Drum/wheel
D: Flag line
E: Flagpole
F: Pulley
G: Guide tube
H: Lid
I: Engine
J: Partition
K: Hoop/ring
L: Pipe
M: Control unit
N: Engine for lid
O: Heat fan
P: Air valve
Q: Flag
R: Pennant/flag
S: Sensor
T: Power source

SMARTFLAG

CROSS-REFERENCE TO RELATED APPLICATIONS

This application is the United States National Phase of Patent Application No. PCT/NO2017/050067 filed 15 Mar. 2017, which claims priority to Norwegian Patent Application No. 20160463 filed 16 Mar. 2016 each of which are incorporated herein by reference.

TECHNICAL FIELD

The present invention relates to a device for automatically raising a flag, more specifically to a device for automatically raising and lowering one or more flags and pennants.

BACKGROUND OF THE INVENTION

To raise or lower a flags or a pennant is a daily occurrence in both private, public or commercial use. Using the national flag is linked a set of rules for when to raise or lower a flag. It is therefore required, at least in public respect, that a person is responsible for raising and lowering the flag at the right time. This requires physically, a person present.

There are currently few options for automatically raising and lowering a flag, but these are not commercialized and have limitations regarding the number of flags that can be raised on the same flagpole.

US2008121167 discloses a method that automatically raises and lowers a flag. The flag is stored in a box when not in use.

U.S. Pat. No. 9,093,001 describes a solution in which the flag is rolled into the pole when it is not in use.

WO9709500 describes a solution that is a combination of US2008121167 and U.S. Pat. No. 9,093,001. In this solution, the flag is stored in a hollow cylinder at the foot of the mast.

FR2937779 discloses a somewhat different solution where the motor that raises and lowers the flag at the top of the flagpole. In this solution, there is no container for storing the flag when it is not in use, nor is this solution automatic since a user has to use a kind of remote control for raising and lowering the flag. This solution has the advantage that the motor is supplied with energy from a solar collector. However, there is no benefit in having the engine at the top of the flagpole as this is dangerous if it were to fall down, further maintenance is a lot more difficult, and a heavy object in the top of the flagpole increases the risk of breaking the flagpole considerably.

All these solutions have major limitations, namely they only have the ability to raise and lower one flag, they can be downright dangerous or they require manual handling.

From U.S. Pat. No. 1,508,980 A it is known a system for raising and lowering a flag comprising a flag tied to a line, a flagpole and a container. In the container there is a drum divided into two different compartments, separated by a flange and where each end of the line is fastened to each of the compartments. A handle is used to rotate the drum in order to raise and lower the flag.

CN 2537763 Y describes a solution comprising an automatic flag raising unit.

SUMMARY OF THE INVENTION

It is therefore an object of the present invention as described in the set of claims, solving the problems mentioned above.

The solution is in the form of a device mounted at the base of a flagpole. The apparatus has two sets of drums controlled by at least one motor. At the top of the flagpole it is fastened a pulley which the line runs through.

When the line is rolled onto one drum it is rolled out of the other and vice versa. This means that you can have at least two different flags or pennants attached to the system. The system works in the way that when a flag is lowered, another flag is raised. The system may further be expected to be self-powered via eg. solar cells that charge a set of batteries.

Furthermore, one of the benefits of the device is that it does not require hands-on control and can be programmed to raise and lower the flag / streamers as may be desired. The device is made of sturdy materials and can be used in all types of climates. The device is driven by electric motors receiving power via an external power source or by for example by charging a battery using solar cells.

BRIEF DESCRIPTION OF THE DRAWINGS

FIG. 1 shows a perspective view of an embodiment of the present invention.

DETAILED DESCRIPTION

FIG. 1 comprises a box A. The box, A, contains at least two drums, B and C. Around these drum, B and C, it is rolled one line, D, in and out. The line, D, extending from a first drum, B, via the top of the flagpole to the second drum, C. At the top of the flagpole there can be attached a pulley, ball bearings F4, etc. which the line passes over. The drums are guided by at least one motor, I, powered by power source T. This motor, I, drives the drums around in the same direction so that when the line, D, is unwounded from the first drum, it is wound onto the second drum and vice versa. During starting up, an engine, N, opens the lid, H. The motor, I, drives the drum (B) and (C) around which the flag line, D is rolled into one drum while it unwinds from the second drum.

When starting the motor it will initiate an operation in which the drum C rolls line D and the flag Q towards drum C, while drum B will roll out line D and another pennant/flag R. The flag Q will follow the flagpole E and through a clamp K and pipe L down past the lid H and pulley F before being rolled up on the drum C. Drum C will go around enough turns until the flag Q is rolled around the drum C. The partition J ensures that the flag Q and flag/pennant R and line D is not twisted together.

While the flag is pulled down into the box A, the drum B release line passing pulley F and further into the guide tube G, past pulley F and further up through the lid H, pipes L and hoop or ring K and further up to the top of the flagpole. Attached to the line D is another flag/pennant R coming to the top of the flagpole E while the flag Q of the drum C is completely rolled around drum C. Since the drum B in this case rolls out the line D, a brake is attached to the motor in order to ensure that the line D is kept taught.

The operation can be reversed so that the drum B and C respectively raises and lowers the flag and pennant as desired.

The engine I can be instructed to start and stop by a control unit M which is programmed via the wireless device like a mobile or similar. The control unit M holds information on when the flag Q or pennant R should go up or down There are sensors S on the line D to ensure that the device engine stops when the flag Q and/or pennant R is respectively rolled around the drum B/C or has reached the top.

The device consists of a closed box containing drum B etc. and/or wheels and pathways that challenge/streamer should lie around one or more drum/wheels when reeled in during checkout. The drum/wheels sit on the hub and is driven by motors and can be mounted side by side or superposed. The box is mounted adjacent the flagpole ground floor.

The box can be equipped with a fan and a heater which dries the flag/pennant if it is wet. The box contains two chambers that ensures that the flags at each end of the line do not twist together. The drum can be mounted side by side and/or superposed. Provided that they are operated independently.

The device is designed so that when the flag is on its way into the box, it will simultaneously be another flag/pennant on the way out of the box as they change places on the flagpole.

The line passes through the top of the flagpole in the traditional manner, and the ends of the line in both ends being attached to each drum. The line is attached to one or more flags and/or pennants.

The device are driven by motors which open/close the lid on top of the housing and which drives the drum to raise and/lower a flag and flags. The line is held taut by springs and/or by braking the motor/drum so that the flag and the line not to wind up and the device breaks.

On the side of the box where the flag comes in/out of the box, there is a lid that opens and closes so that moisture does not enter. This cover also acts as a lock for the line when the flag is raised.

On the upper side of the box it is mounted clamps and/or pipes to the flagpole leading the flag up/down in a smooth motion, so that the flag and the line coming down in sequence down into the box and around the drum. The clamps/pipes also ensure that the flag does not touch the ground.

Operation 1:

By starting the motor of the drum C drag the line D and the flag Q towards drum C while drum B will release line D and another pennant/flag R. The flag Q will follow the flagpole E and the yokes K and pipe L down past lid H and pulley F before being rolled up on the drum C. drum C will revolve enough turns to ensure that the flag Q is completely rolled around drum C. The partition J ensures that the flag Q and flag/pennant R and line D is not twisted together.

Operation 2:

While operation 1 above is occurring, the drum B release line passing pulley F and further into the guide tube G, past pulley F and further up through the lid H, pipes L and hoop/ring K and further up to the top of the flagpole. Attached to line D is another flag/pennant R coming to the top of the flagpole E while the flag Q of the drum C is completely rolled around drum C. Since the drum B in this case rolls out the line D, a brake is attached to the motor in order to ensure that the line D is kept taught.

Operation 1 and Operation 2 could be reversed so that the drum B and C respectively raises and lowers the flag and pennant as desired. The operations may be repeated and performed any number of times.

The motors I can be instructed to start and stop via a control unit M which is programmed via a wireless devices such as mobile or similar. The control unit M holds information on when the flag Q or pennant R should be up or down.

There are sensors on the line D such that the device engine stops when the flag Q and/or pennant R is respectively rolled around the drum B/C or to the top.

The invention claimed is:

1. A system for raising at least one flag or pennant (Q, R) while lowering at least one other flag or pennant (Q, R), the system comprising:

two or more flags or pennants (Q, R) attached to a line (D), said line is at one end attached to a first drum (B) and extends from that first drum (B) via a pulley or ball bearings toward a top of a flagpole (E) and is attached to a second drum (C), wherein the first and second drums (B, C) are placed in a container (A) located toward a bottom of the flagpole, the container (A) has at least two chambers, with one drum (B, C) in each chamber, said drums (B, C) being controlled by at least one motor (I), said motor (I) driven by a power source; and when the flag or pennant (Q, R) being wrapped around the first drum is rolled out from the first drum (B) by the line out of the container and toward the top of the flagpole, another flag or pennant (Q, R) is rolled into the container and onto the second drum (C); and a plurality of sensors located on the line (D) such that the motor (I) stops when the flag (Q) and/or pennant (R) is respectively rolled around the drum (B, C) or to the top of the flagpole (E).

2. System according to claim 1 wherein said container (A) includes a watertight cap (H) controlled by a motor (N).

3. System according to claim 1 wherein said container (A) can be heated.

4. System according to claim 3 wherein said power source can be either line voltage or a battery charged by a solar cell.

5. System according to claim 1 wherein said container (A) has an air valve (P).

6. System according to claim 1 wherein said container (A) comprising a control unit (M) for controlling the components of the container.

7. The system according to claim 1 wherein the container (A) includes a partition J located between the at least two chambers, drum (B) being located in one chamber and drum (C) being located in another chamber.

8. The method according to claim 1 wherein the container (A) includes a partition J located between the at least two chambers, drum (B) being located in one chamber and drum (C) being located in another chamber.

9. A method for raising at least one flag or pennant (Q, R) while lowering at least one other flag or pennant (Q, R), said method comprising:

attaching two or more flags or pennants (Q, R) to a line (I)), said line is at one end attached to a first drum (B) and extends from the first drum (B) via a pulley or ball bearings at a top of a flagpole (E) and is attached onto a second drum (C) wherein said first and second drums (B, C) are placed in a container (A) located at a bottom of the flagpole. said container (A) has at least two chambers, with one drum (B, C) in each chamber, controlling said drums (B, C) by at least one motor (I), said motor (I) being driven by a power source, and when the flag or pennant (Q, R) being wrapped around the first drum is rolled out from the first drum (B) by the line out of the container and toward the top of the flagpole, another flag or pennant (Q. R) is rolled into the container and onto the second drum (C) and there are a plurality of sensors located on the line (D) such that the motor (I) stops when the flag (Q) and/or pennant (R) is respectively rolled around the drum (B, C) or to the top of the flagpole (E).

* * * * *